US005253026A

United States Patent [19]

Tamary

[11] Patent Number: 5,253,026

[45] Date of Patent: Oct. 12, 1993

[54] FUSING APPARATUS HAVING VARIABLE SHAPE FUSER ROLLER

[75] Inventor: Ernest J. Tamary, Brighton, N.Y.

[73] Assignee: Eastman Kodak Company, Rochester, N.Y.

[21] Appl. No.: 812,308

[22] Filed: Dec. 23, 1991

[51] Int. Cl.[5] ..... G03G 15/20

[52] U.S. Cl. ..... 355/289; 355/290; 219/216; 219/469

[58] Field of Search ..... 355/285, 289, 290, 284; 219/216, 469; 432/60; 118/60; 271/272

[56] References Cited

U.S. PATENT DOCUMENTS 3,106,767 10/1963 Fox ..... 29/119
4,253,392 3/1981 Brandon et al. ..... 100/155 R
4,258,648 3/1981 Leising et al. ..... 118/60
4,594,068 6/1986 Bardutzky et al. ..... 432/60
5,130,754 7/1992 Hishikawa ..... 355/282

*Primary Examiner*—Joan H. Pendegrass
*Attorney, Agent, or Firm*—Leonard W. Treash, Jr.

[57] ABSTRACT

A fusing apparatus for fusing toner images onto a substrate. The fusing apparatus has a generally cylindrical pressure roller, a fuser roller, and a device for applying toner release oil to the surface there of. The fuser roller further includes a first length portion that has a generally cylindrical outer shape for contacting the pressure roller to form a fusing nip through which the substrate can be moved. In order to prevent damage to the surface of the fuser roller, the fuser roller includes a second length portion which lies towards an end of the fuser roller away from the fusing nip and has a generally conical outer shape for preventing contact between the fuser roller and pressure roller.

7 Claims, 2 Drawing Sheets

FUSING APPARATUS HAVING VARIABLE SHAPE FUSER ROLLER

BACKGROUND OF THE INVENTION

1. Field of the Invention

The present invention relates to electrostatographic fusing apparatus, and more particularly to a heat and pressure roller-type fusing apparatus having a variable shape fuser roller.

2. Description Relative to the Prior Art

Electrostatographic reproduction machines such as copiers and printers, are well known. Such copiers and printers have fusing apparatus, such as heat and pressure roller-type fusing apparatus which are used therein, for fusing toner images. As disclosed for example in U.S. Pat. No. 4,258,648 issued Mar. 31, 1981 to Leising et al., and U.S. Pat. No. 4,594,068 issued Jun. 10, 1986 to Hardutzky et al., the fuser roller of each such fusing apparatus conventionally has a generally cylindrical outer profile or shape for forming a fusing nip with a generally cylindrical pressure roller. As disclosed additionally in the '648 patent, such a generally cylindrical fuser roller includes a metallic core over which is formed at least one elastomeric layer. It is generally also known as pointed out in the '648 patent to apply toner release oil to the surface of such a fuser roller in order to prevent toner image offset onto such fuser roller from a sheet or substrate carrying the image being fused.

Unfortunately, the applied release oil when absorbed into the elastomeric layer of the fuser roller, ordinarily tends to cause such layer to swell undesirably thereby resulting in unacceptable fusing performance. To prevent such undesirable swelling, a very thin outer layer that is impervious to such release oil may for example be added over the elastomeric layer. Unfortunately however, when such a generally cylindrical fuser roller is mounted so as to form a rolling contact fusing nip with the generally cylindrical pressure roller, its high temperature and pressure required for fusing toner images tend to damage such thin outer layer. Such damage ordinarily will allow the surface applied release oil to penetrate through the damaged portion to the inner elastomeric layer thereby causing undesirable swelling. It has been found that such damage to the thin outer layer of the fuser roller occurs frequently within portions of the cylindrical fuser roller that are towards its ends. Particularly such damage occurs within those end portions of the fuser roller which normally are beyond the edges for example of the image carrying sheet or substrate being fed through the fusing nip. Such end portions are of course are not protected from the pressure roller by such sheet or substrate. Accordingly, in such end portions of the fuser roller, high stresses are created between the directly contacting surfaces of the rollers. Such damage also occurs with great frequency at a point of discontinuity which is generally created in the surface of the fuser roller by the edge of the sheet or substrate, particularly under the high temperatures and pressures required for fusing. As a net result, the thin outer layer or coating at such a point, and towards the ends of the fuser roller, tends to fail or be damaged, thus leading to release oil penetration and undesirable swelling of the fuser roller as described above.

SUMMARY OF THE INVENTION

It is an object of the present invention to provide a fuser roller that is not significantly susceptible to the conditions which result in such undesirable swelling of its elastomeric layer.

In accordance with the present invention, a fuser roller is provided that is suitable for use in a heat and pressure roller-type fusing apparatus to fuse toner images to an image carrying substrate. The fuser roller has an outer surface and first and second ends. The fuser roller includes at least a first length portion and a second length portion. The first length portin has a generally cylindrical outer shape or profile for contacting a generally cylindrical pressure roller so as to form a fusing nip. The second portion has a generlly conical outer shape. The second portion as much adjoins the first portion and tapers from such first portion to one end of the fuser roller so as to prevent contact between the fuser roller and a nip forming pressure roller over the length of such second portion of the fuser roller.

BRIEF DESCRIPTION OF THE DRAWINGS

In the detail description of the invention presented below, reference is made to the drawings, in which.

DETAIL DESCRIPTION OF THE INVENTION

Because heat and pressure roller-type fusing apparatus as used in electrostatographic reproduction apparatus such as copiers and printers are well known, the present description will be directed in particular to only elements of such an apparatus that form part of, or cooperate in the present invention. Elements of such an apparatus not specifically shown or described are assumed to be selectable from those known in the prior art.

Figure 1:
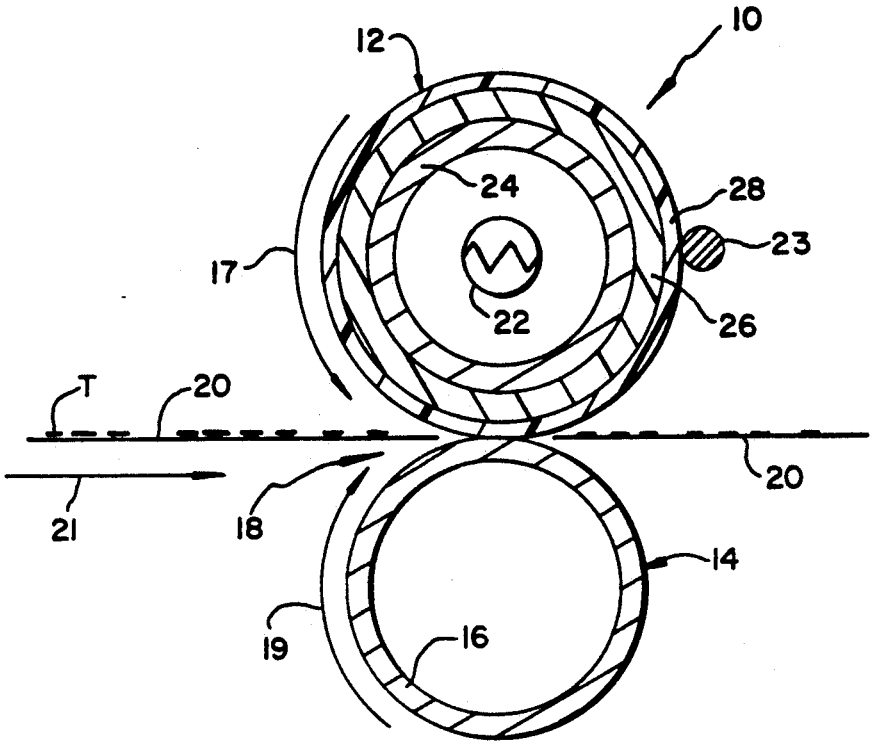
FIG. 1 is a cross-sectional view of the fusing apparatus of the present invention.

Referring now to FIG. 1, a heat and pressure roller-type fusing apparatus of the present invention is illustrated generally as 10. The fusing apparatus 10 includes the fuser roller of the present invention shown generally as 12, and a pressure roller 14 which has a generally cylindrical outer profile or shape. The pressure roller 14 for example may consist of a metallic (aluminum) core 16 which forms a fusing nip 18 with a portion of the fuser roller 12. Both the fuser roller 12 and pressure roller 14 are mounted so that they can be rotated in a manner as shown by the arrows 17 and 19 respectively for feeding an image carrying substrate 20 through the fusing nip 18 in the direction of the arrow 21. As shown, the substrate 20 is fed through the nip 18 such that a toner image T thereon directly faces and contacts the fuser roller 12. For fusing the toner image T onto the substrate 20, the fuser roller 12 is heated for example internally by a heat source 22 to a high temperature suitable for melting and fusing the toner particles which form the image T.

In order to prevent the image T from offsetting from the substrate 20 onto the roller 12, a device such as a wicking or oiling roll 23 is mounted against the fuser roller 12 for applying toner release oil to the surface thereof. Additionally as is well known, suitable means (not shown) are provided for loading or forcing the pressure roller 14 against such portions of the fuser roller 12 that are in nip-forming contact therewith.

Figure 2:
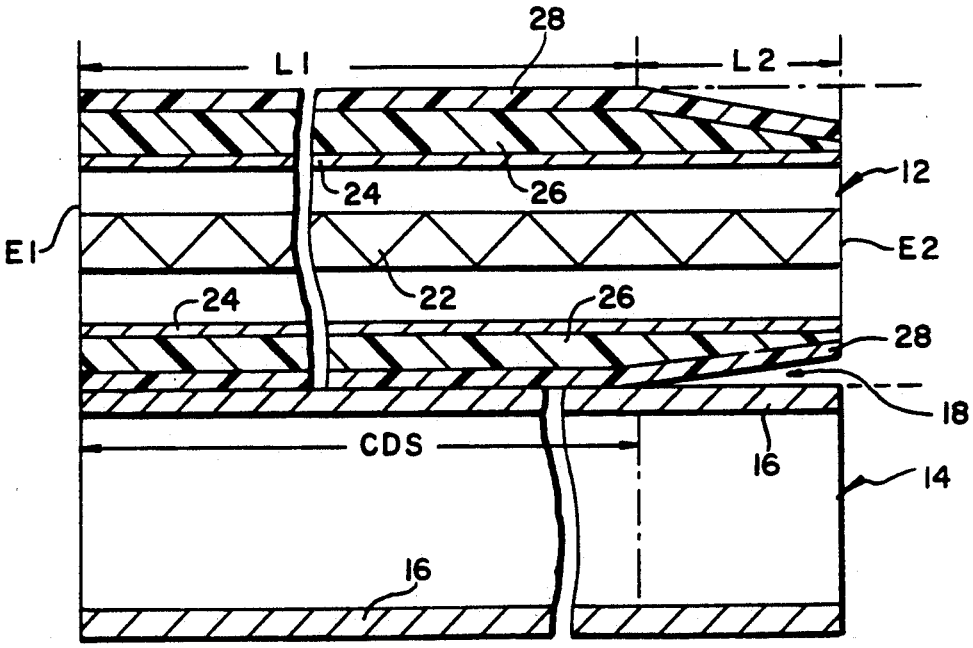
FIG. 2 is a longitudinal section of the apparatus of FIG. 1 showing a first embodiment of the fuser roller of the present invention.
Figure 3:
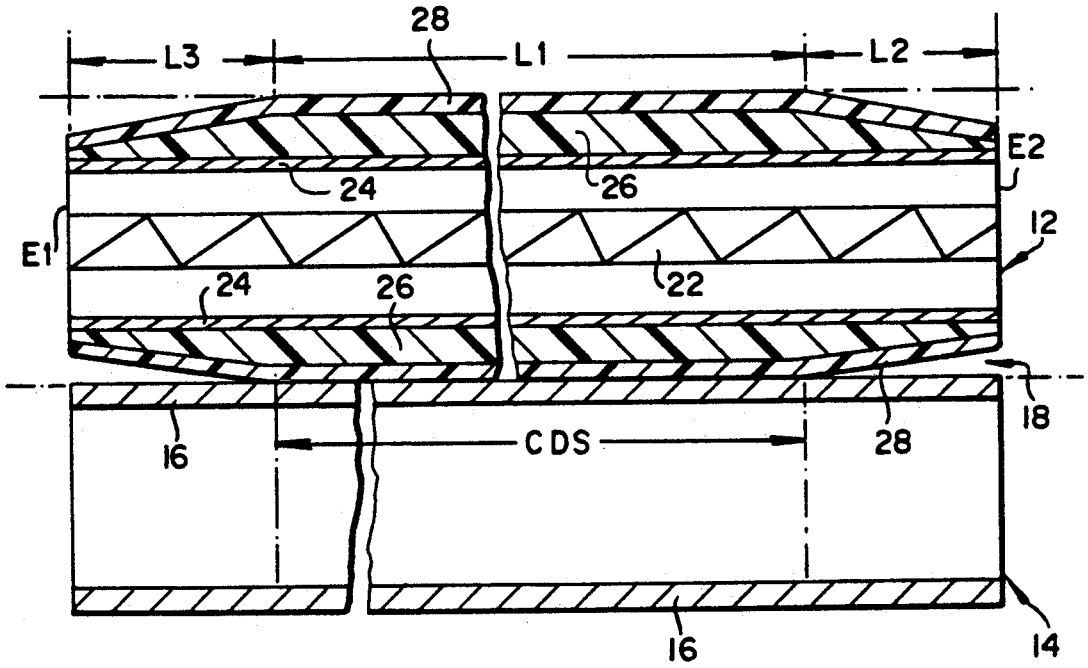
FIG. 3 is a longitudinal section similar to FIG. 2 but showing a second embodiment of the fuser roller of the present invention.

Referring now to FIGS. 1-3, the fuser roller 12 of the present invention has first and second ends shown as E1 and E2 respectively, and comprises a rigid core 24 for example a metallic (aluminum) core, and at least one elastomeric (silicone rubber) layer 26 formed over the core 24. As shown, at least a second, outer layer such as the layer 28, which preferably is impervious to the release oil being applied by the oiling device 23, may also be formed over the first layer 26. More importantly, the fuser roller 12 includes a first length portion shown as L1 which has a generally cylindrical outer profile or shape that is adapted for contacting the generally cylindrical pressure roller 14 to form the fusing nip 18. The first length portion L1 as such should be long enough to form a nip 18 which is at least as long as the cross-track dimension, shown as CDS (FIGS. 2 and 3), of a substrate 20 being fed therethrough. Accordingly, the first, cylindrical length portion L1 of the fuser roller 12 should be at least as long as, or substantially equal to, the cross-track dimension of the substrates 20 to be fed through the fusing nip 18.

Referring in particular to FIG. 2, a first embodiment of the fuser roller 12 of the present invention is shown in which the first length portion L1 thereof runs from the first end E1 thereof towards the second end E2. As further shown, the fuser roller 12 of the first embodiment includes a second length portion L2 which has a generally conical outer profile or shape that adjoins the first length portion L1 and that tapers or narrows from the first length portion L1 towards the second end E2. The taper of the second length portion L2 as such should be significant enough so as to prevent contact between such second length portion L2 of the fuser roller 12 and the pressure roller 14. In accordance with the present invention, preventing such contact serves to avoid damage to the surface layer 28 of the fuser roller over the second length portion L2, thus preventing release oil from penetrating in areas of such damage and reaching the underlayer 26. Advantageously, undesirable swelling of underlayer 26 is thus prevented resulting in prolonged and acceptable fusing perfomance by the fusing apparatus 10.

As further shown, given a generally cylindrical core 24, the fuser roller 12, having the taper or conical shape of the second length portion L2, can be formed for example as follows. The first elastomeric layer 26 can be formed over the generally cylindrical core 24 such that the layer 26 has a uniform thickness over a lentgth of the roller 12 that is coextensive with the first length portion L1 thereof. From the first length portion L1, the layer 26 can then be formed to extend over the second length portion L2 with a thickness that tapers or decreases from the first portion L1 to the second end E2. The second, and outer layer 28 preferably should then be formed over the first layer 26 such that it has a generally common or uniform thickness over the first layer 26.

Referring now to FIG. 3, a second embodiment of the fuser roller 12 of the present invention is shown in which the first length portion L1 is situated to the center of the fuser roller. The fuser lroller 12 of the second embodiment therefore includes two second length portions L2 and L3 located respectively towards the second end E2 and first end E1 thereof. Preferably, the two second length portions L2, L3 are equal in length so as to result in a generally symmetrical fuser roller 12. As shown, the layers 26, 28 of the roller 12 of the second embodiment can be formed over a generally cylindrical core 24 in the same manner as in the first embodiment as described above.

As can be seen, a fuser roller 12 of the present invention having a variable shape has been provided for use in heat and pressure roller-type fusing apparatus to achieve prolonged and acceptable fusing performance. The fuser roller of the present invention is shaped so as to prevent stressful and damaging contact between a generally cylindrical pressure roller and end portions of the fuser roller are not protected from the pressure roller by a substrate 20 for example.

The invention has been described in detail with particular reference to presently preferred embodiments, but it will be understood that variations and modifications can be effected within the spirit and scope of the invention.

What is claimed is:

1. A fuser roller for use in a heat and pressure roller-type fusing apparatus to fuse toner images to a substrate, the fuser roller having first and second ends and comprising:

(a) a first length portion for contacting the substrate, said first length portion having a cylindrical outer shape; and (b) a second length portion for preventing contact of the fuser roller with a cylindrical pressure roller forming a fusing nip with the fuser roller, said second length portion having a conical outer shape and an elastomeric layer decreasing in thickness towards one end of the first and second ends of the fuser roller, and said second length portion adjoining said first length portion as well as said one end of the first and second ends of the fuser roller.

2. The fuser roller of claim 1 wherein the length of said first length portion of said fuser roller is substantially equal to the cross-track dimension of the substrate relative to movement of the substrate over the fuser roller.

3. A fuser roller having a cylindrical first length portion and a conical second length portion, the fuser roller comprising:

(a) a cylindrical core extending from a first end to a second end thereof; and (b) at least a first elastomeric layer formed over said core, said first elastomeric layer including:

(i) a first portion thereto having a uniform thickness, said first portion being coextensive with the first length portion of the fuser roller; and (ii) a second portion having a thickness decreasing from said first portion of said elastomeric layer towards one of the first and second ends of the fuser roller.

4. The fuser roller of claim 3 including a second layer formed over said first layer, said second layer having a uniform thickness from said first end to said second end of said fuser roller.

5. The fuser roller of claim 4 wherein said fuser roller includes two said conical second length portions thereto.

6. The fuser roller of claim 4 wherein said second layer is impervious to toner release oil.

7. A fusing apparatus for fusing toner images onto an image carrying a substrate, the fusing apparatus comprising:

(a) a cylindrical pressure roller mounted for rotatably contacting a first side of the image carrying substrate; and (b) a heated fuser roller mounted forming a fusing nip with said pressure roller for contacting the second side of such substrate, said fuser roller having first and second ends and including:

(i) a first length portion for contacting said cylindrical pressure roller, said first length portion having a cylindrical outside shape; and (ii) a second length portion for preventing contact of the fuser roller with the cylindrical pressure roller, said second length portion having a conical outside shape and an elastomeric layer decreasing in thickness towards one end of the first and second ends of the fuser roller, and said second length portion adjoining said first length portion as well as said one end of the first and second ends of the fuser roller.

* * * * *